United States Patent [19]

Freudenschuss et al.

[11] Patent Number: 4,729,357

[45] Date of Patent: Mar. 8, 1988

[54] CONTROL SYSTEM FOR CONTROLLING AN INTERNAL COMBUSTION ENGINE PROVIDED WITH AT LEAST ONE FUEL INJECTION PUMP

[75] Inventors: Otto Freudenschuss, Vienna; Leopold Rollenitz, Kirchstetten; Josef Morell, Tulbinger Kogel; Harald Schmidt, Vienna, all of Austria

[73] Assignee: Steyr-Daimler-Puch AG, Vienna, Austria

[21] Appl. No.: 905,888

[22] Filed: Sep. 10, 1986

[30] Foreign Application Priority Data

Sep. 20, 1985 [AT] Austria ..... 2746/85

[51] Int. Cl.[4] ..... F02M 39/00

[52] U.S. Cl. ..... 123/365; 123/198 D; 123/357

[58] Field of Search ..... 123/357–359, 123/198 D, 372, 373, 365

[56] References Cited

U.S. PATENT DOCUMENTS

| | | | |
|---|---|---|---|
| 3,640,259 | 2/1972 | Garcea | 123/365 |
| 4,000,928 | 1/1977 | Kurokawa | 123/373 |
| 4,243,104 | 1/1981 | Ritter | 123/358 |
| 4,570,588 | 2/1986 | Herdin | 123/365 |
| 4,604,977 | 8/1986 | Ohnishi | 123/365 |
| 4,616,616 | 10/1986 | Staniak | 123/365 |

FOREIGN PATENT DOCUMENTS

| | | | |
|---|---|---|---|
| 290212 | 5/1971 | Austria . | |
| 318975 | 11/1974 | Austria . | |
| 0044289 | 1/1982 | European Pat. Off. . | |
| 0152711 | 12/1979 | Japan | 123/365 |
| 0083527 | 7/1981 | Japan | 123/359 |
| 1392187 | 4/1975 | United Kingdom . | |
| 2002059 | 2/1979 | United Kingdom . | |

*Primary Examiner*—Carl Stuart Miller

*Attorney, Agent, or Firm*—Marmorek, Guttman & Rubenstein

[57] ABSTRACT

A control system for controlling an internal combustion engine which is provided with at least one fuel injection pump which comprises for the control of the fuel injection pump a control rod, a servomotor, which is adapted to be mechanically coupled to said control rod, and a microcomputer for controlling said servomotor in dependence on operating conditions of the engine and on the position of an arbitrarily operable travel control lever. Means are provided for establishing a direct mechanical connection between the arbitrarily operable travel control lever and the control rod so that the latter can be moved under the control of the travel control lever in case of a failure of the electric system which comprises the sensors, the microcomputer and the servomotor.

15 Claims, 4 Drawing Figures

CONTROL SYSTEM FOR CONTROLLING AN INTERNAL COMBUSTION ENGINE PROVIDED WITH AT LEAST ONE FUEL INJECTION PUMP

BACKGROUND OF THE INVENTION

1. Field of the Invention

This invention relates to a control system for controlling an internal combustion engine which is provided with at least one fuel injection pump, more particularly to such control system which comprises for the control of the fuel injection pump a control rod, a servomotor, which is adapted to be mechanically coupled to said control rod, and a microcomputer for controlling said servomotor in dependence on operating conditions of the engine and on the position of an arbitrarily operable travel control lever.

2. Description of the Prior Art

A known control system of that kind is disclosed in No. EP-A-0 044 289.

The operating conditions of the engine may be indicated, e.g., by the charging pressure, the engine temperature, the ambient temperature, the fuel temperature, the engine speed or other parameters. One of the signals delivered to the microcomputer is generated by a sensor in response to the instantaneous position of the arbitrarily operable travel control lever. The control rod for controlling the quantity of fuel delivered by the fuel injection pump is operated in response to the output signals of the microcomputer so that a separate stop for limiting the quantity of fuel delivered by fuel injection pump is no longer required.

That known control system is relatively simple and comprises only a few movable parts, but has the important disadvantage that in case of a failure of the electric system comprising the sensors, the microcomputer and the servomotor the internal combustion engine can no longer be controlled because an arbitrary control action is no longer possible. For this reason the system is unreliable and this is not tolerable, e.g., in connection with ship engines.

SUMMARY OF THE INVENTION

It is an object of the invention to eliminate that disadvantage and so to improve the control system which has been described first hereinbefore that the engine can be controlled even in an emergency.

This object is accomplished in accordance with the invention that means are provided for establishing a direct mechanical connection between the arbitrarily operable travel control lever and the control rod so that the latter can be moved under the control of the travel control lever in case of a failure of the electric system which comprises the sensors, the microcomputer and the servomotor.

In the improved system the control rod can be mechanically operated by the travel control lever. The electronic control and all advantages afforded by it are fully preserved but the electric system can be mechanically bridged in an emergency.

Within the scope of the invention the means for mechanically connecting the servomotor to the control rod comprise a lever, which is spring-biased to an inoperative position, and a pawl, which is pivoted to the control rod and spring-biased to a position of rest and carries a first stop with which the first lever is engageable. A second lever is provided, which is mechanically connected by a linkage or the like to the travel control lever and the position of which is detected by the sensor for detecting the position of the travel control lever. The pawl carries a second stop, which is disposed in the path of the pivotal movement of the second lever only in case of a failure of the electric system. In that arrangement, the second lever is mechanically connected to the control rod only when the pawl is in its position of rest. As a result of an initial operation of the servomotor the lever for mechanically connecting the servomotor to the control rod imparts to the pawl a pivotal movement by which the second stop of the pawl is moved out of the path of the pivotal movement of the second lever. Only when the first lever is in its inoperative position because the electric system has failed will the pawl remain in its position of rest so that the second stop carried by the pawl is then disposed in the path of the pivotal movement of the second lever, which is mechanically connected to the travel control lever by a linkage or the like and can be operated to adjust the control rod. The position of the second control lever is detected by the sensor for detecting the position of the travel control lever.

In a particularly desirable arrangement the first lever for mechanically connecting the servomotor to the control rod is arranged to be pivotally moved to an initial actuated position by the servomotor in response to the energization of the electric system and during its movement from its inoperative position to said initial actuated position imparts to the pawl a pivotal movement out of its position of rest to a position in which the second stop is disposed outside the path for the pivotal movement of the second lever so that the latter is then uncoupled from control rod. There will be no backlash between the servomotor, the first lever, the first stop carried by the pawl and the control rod when first lever is in that initial actuated position. As a result, the servomotor will then be operable to move the control rod from a predetermined position exactly in accordance with the output data of the computer.

When the electric system has been bridged during an emergency operation, a racing of the internal combustion engine and a destruction of the engine by such racing must reliably be prevented without a substantial structural expenditure, i.e., without the need for a governor. This requirement is met in accordance with the invention by the provision of a delivery-limiting stop, which is engageably by the second lever during its pivotal movement and limits the movement which is imparted to the control rod to increase the quantity of fuel that is injected by the pump so that said quantity is limited too. It will be understood that said delivery-limiting stop may be adjustable.

In order to accommodate the two levers and the pawl provided with the two stop pins in a small space, the two levers are mounted one beside the other on a common pivot and the stops carried by the pawl consist of pins, which differ in length and are parallel to the common pivot.

DETAILED DESCRIPTION OF THE PREFERRED EMBODIMENT

Figure 1:
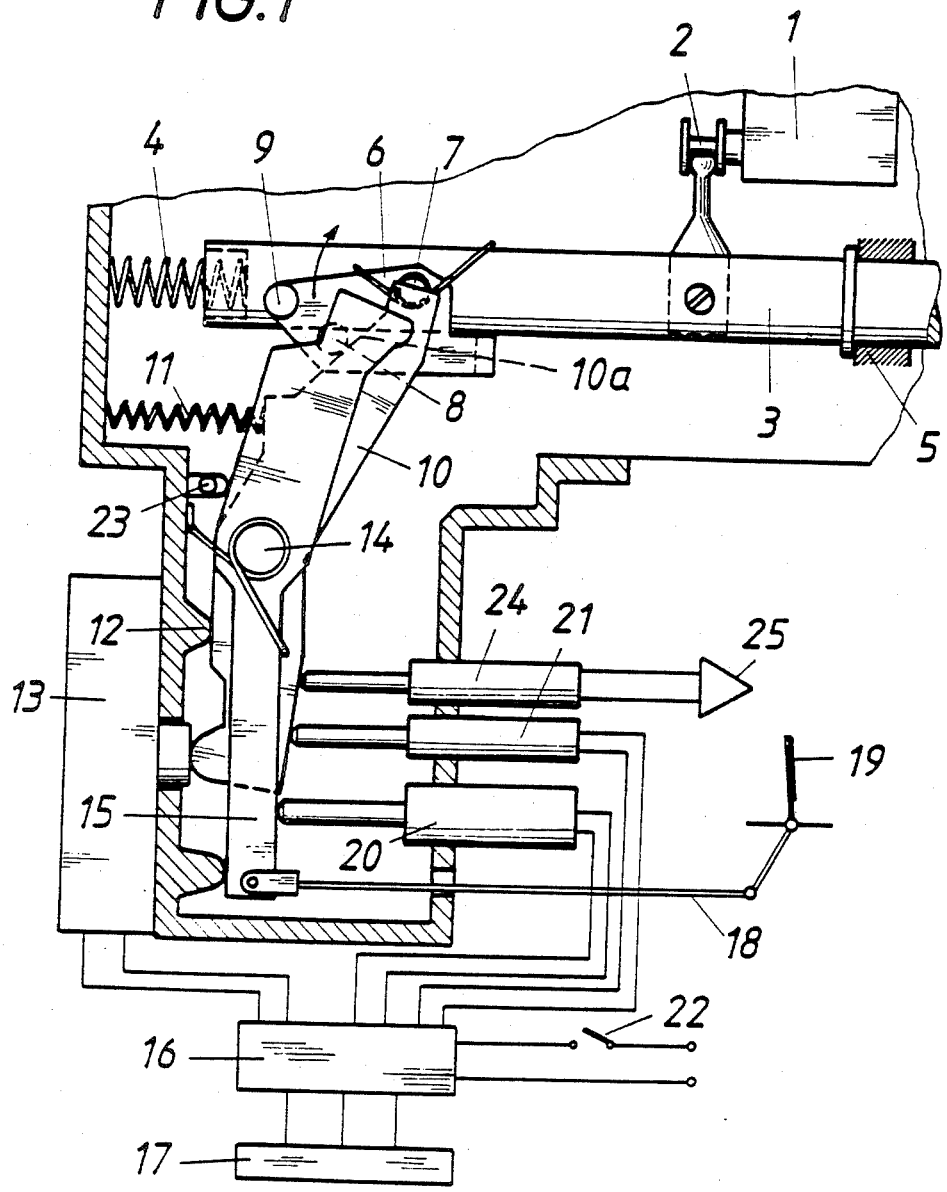
FIGS. 1 to 4 show certain parts of a control system for controlling an internal combustion engine provided with a fuel injection pump, specifically those parts which are essential for the invention. Said parts are shown in four operating positions.

An illustrative embodiment of the invention is partly diagrammatically shown on the drawing.

A unit 1 associated with a cylinder of an internal combustion engine comprises a fuel injection pump and a fuel injection nozzle. The quantity of fuel which is injected by said unit is controlled by a final control element 2, which is adjusted by a control rod 3. The control rod 3 is urged by a spring 4 toward a stop 5 and when engaging said stop 5 in the position shown in FIG. 1 maintains the fuel injection pump in a condition for zero delivery. It will be understood that the control rod 3 may be used to adjust the final control element 2 of a plurality of units 1 associated with respective cylinders of the internal combustion engine. A pawl 6 is pivoted to the control rod 3 on a pivot 7 and is urged by a spring toward a position of rest shown in FIGS. 1 and 4. The pawl 6 carries first and second stops, which consists of transverse pins 8, 9. The first stop consists of the pin 8, which is shorter than the pin 9, which constitutes the second stop. During normal operation the control rod 3 is actuated by means of a first lever 10, which is urged by a spring 11 toward an inoperative position in engagement with a stop 12. A servomotor 13 is operable to pivotally move the first lever 10 away from the stop 12 about a pivot 14, on which a second lever 15 is pivoted beside the first lever 10. The first stop 8 of the pawl is associated with the first lever 10 and the second longer pin 9, which constitutes the second stop carried by the pawl 6, is associated with the second lever 15.

The servomotor 13 is controlled by the microcomputer 16, which is supplied by a plurality of sensors 17 with signals representing various parameters which depend on the operating conditions of the internal combustion engine. The second lever 15 is mechanically connected by a spring-biased linkage 18 or the like to an arbitrarily operable travel control lever 19. An additional sensor 20 detects the instantaneous position of the second lever 15 and delivers corresponding output signals to the microcomputer 16. The sensor 20 virtually constitutes a set point signal generator. A sensor 21 delivers to the microcomputer 16 an output signal which indicates the actual position of the first lever 10.

Figure 2:
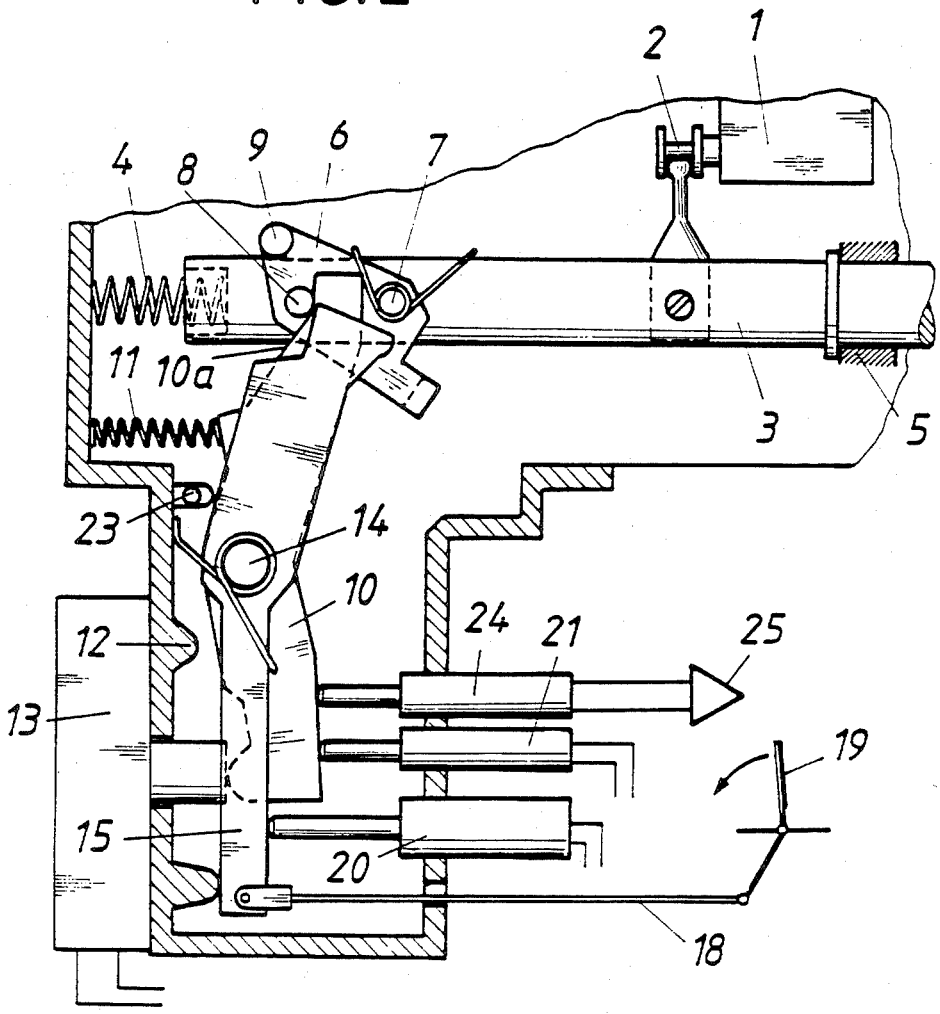
Figure 3:
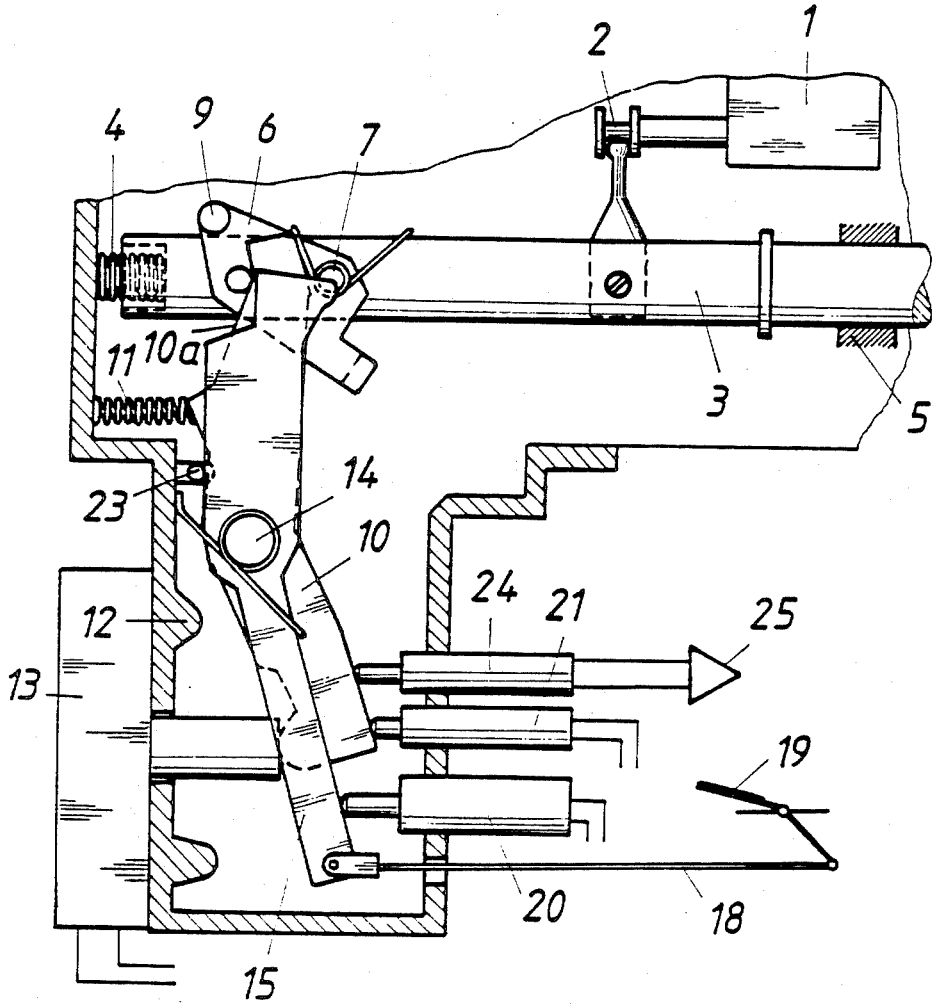

When the entire system is in the position of rest shown in FIG. 1, the switch 22 can be closed to energize the entire electric system which comprises the sensors 17, 20 and 21, the microcomputer 16 and the servomotor 13. As a result, the servomotor 13 pivotally moves the first lever 10 to the initial actuated position shown in FIG. 2, in which the control rod 3 is still in position of rest but the oblique cam face **10*a* of the first lever 10 and the pin 8 which constitutes the first stop 8 carried by the pawl 6 have cooperated to pivotally move the pawl 6 out of its position of rest to a second position, in which the second stop 9 carried by the pawl 6 is outside the path for the pivotal movement of the second control lever. The first stop 8 is so short that it is always disposed outside said path. When the travel control lever 19 is then operated to impart a pivotal movement to the second lever 15, the resulting position of the second lever 15 will be detected by the sensor 20 and, as a result, the microcomputer will impart to the final control element for the servomotor 13 a movement which depends on the angular position of the second lever 15. As a result, a pivotal movement beyond the initial actuated position will be imparted to the first lever 10 by the servomotor 13 and the first lever 10 engaging the first stop or pin 8 will move the control rod 3 out of its position of rest. This will result in an adjustment of the final control element 2 for the fuel injection pump of the unit 1 so that that pump will now deliver the required quantity of fuel. FIG. 3 shows the system in the position in which the travel control lever 19** has been actuated to the largest possible extent so that the largest possible quantity of fuel is being delivered.

Figure 4:
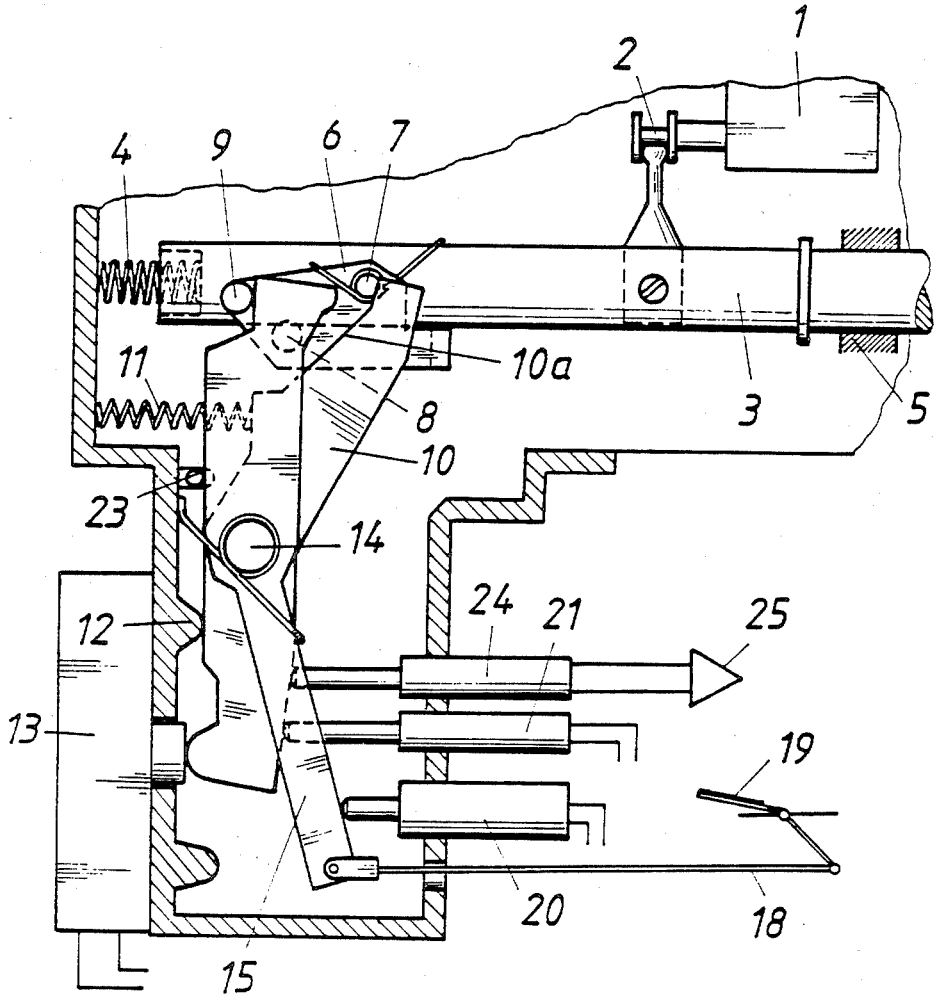

In case of a failure of the electric system which has been described, regardless of the reason for such failure, an emergency operation can readily be maintained by means of the travel control lever 19 because the first lever 10 has returned to its inoperative position, which is defined by the stop 12, and the pawl 6 has been spring-biased to its position of rest. As a result, the second stop or pin 9 extends into the path for the pivotal movement of the second lever 15 so that a mechanical connection is established between the travel control lever 19 and the control rod 3. FIG. 4 shows the position in which the travel control lever 19 has been actuated to the largest possible extent but the pivotal movement of the second lever 15 is limited by an adjustable stop 24 so that the control rod 3 has not been actuated to the position corresponding to the largest possible quantity of fuel. When the first lever 10 reaches its inoperative position, a switch 24 is automatically closed to energize a lamp 25 or the like, which will then indicate the failure of the electric system.

We claim:

1. A control system for controlling an internal combustion engine which is provided with variable-delivery fuel injection pump means, comprising an arbitrarily operable travel control lever, a control rod, which is axially movable in a predetermined direction to increase the delivery of said pump means, a servomotor, a first mechanism for mechanically connecting said servomotor to said control rod, which first mechanism is operable by said servomotor to move said control rod in said predetermined direction, first spring means opposing the movement of said control rod in said predetermined direction, a plurality of sensors for generating output signals representing the position of said travel control lever and at least one parameter which depends on the operating condition of the engine, a microcomputer for receiving said output signals and for controlling the operation of said servomotor in dependence on said output signals, a second mechanism which is mechanically connected to said travel control lever and mechanically operable by said travel control lever to move said control rod in said predetermined direction, and coupling means for initially coupling said second mechanism to said control rod and for initially uncoupling said first mechanism from said control rod, and for uncoupling said second mechanism from said control rod and for coupling said first mechanism to said control rod in response to a predetermined operation of said servomotor.

2. In a control system for controlling an internal combustion engine provided with variable-delivery fuel injection pump means, which system comprises an arbitrarily operable control lever, an axially movable control rod, a servomotor, which is operable to move said control rod in a predetermined axial direction, a plurality of sensors for generating output signals representing the position of said control lever and at least one controlled variable, and a controller for receiving said output signals and for controlling the operation of said servomotor in dependence on said output signals, the improvement residing in that a first lever is provided for mechanically connecting said servomotor to said control rod, which first lever is pivotally movable by said servomotor to move said control rod in said predetermined axial direction, a second lever is provided, which is mechanically connected to said control lever and pivotally movable by said control lever to describe a predetermined path, first spring means are provided, which oppose the movement of said control rod in said predetermined direction, a pawl for alternatively coupling said first and second levers to said control rod is pivoted to said control rod and carries first and second stops, second spring means are provided, which urge said pawl to a position of rest, in which said second stop extends in said path, third spring means are provided, which urge said first lever to a predetermined inoperative position, said servomotor is operable to pivotally move said first lever against the force of said third spring means from said inoperative position to and beyond a predetermined initial actuated position, said first lever is arranged to engage said first stop to said initial actuated position, and said first lever has moved from said inoperative position to said initial actuated position, and said pawl is arranged to move from said position of rest to a second position, in which said first and second stops are disposed outside said path, as said first lever is pivotally moved beyond said initial actuated position.

3. A control system for controlling an internal combustion engine, comprising, a fuel injection pump, controlling means connected to said pump for controlling the delivery of said pump, an electrical system including a servomotor, a plurality of sensors for generating output signals in response to the operating condition of said engine, and a microcomputer for receiving said output signals, said microcomputer controlling the operation of said servomotor in response to said output signals, first connecting means for mechanically connecting said servomotor to said controlling means, said first connecting means being operable by said servomotor to operate said controlling means in response to a first predetermined operation of said electrical system, second connecting means connected to said controlling means for operating said controlling means in response to a second predetermined operation of said electrical system, a selectively operable lever mechanically connected to said second connecting means, means for selectively coupling said first connecting means to said controlling means in response to said first predetermined operation of said electrical system, said means uncoupling said first connecting means and coupling said second connecting means to said controlling means in response to said second predetermined operation of said electrical system, wherein said controlling means controls the delivery of said pump when said second connecting means is coupled to said controlling means.

4. The control system set forth in claim 1, wherein said second mechanism comprises spring means opposing the operation of said second mechanism in a sense corresponding to a movement of said control rod in said predetermined direction.

5. The control system set forth in claim 1, wherein said coupling means comprise second spring means urging said coupling means to a position of rest, in which said second mechanism is coupled to said control rod, said first mechanism comprises third spring means urging said first mechanism toward an inoperative position, said servomotor is operable under the control of said microcomputer to move said first mechanism against the force of said third spring means from inoperative position to and beyond a predetermined initial actuated position, and said coupling means are arranged to move against the force of said second spring means from said position of rest to a second position, in which said first mechanism is coupled to said control rod and said second mechanism is uncoupled from said control rod, in response to the movement of said first mechanism from said inoperative position to said initial actuated position.

6. The control system set forth in claim 5, wherein said servomotor is operable to move said first mechanism against the force of said third spring means from said inoperative position to said predetermined initial actuated position in response to an initial energization of said microcomputer.

7. The control system set forth in claim 6, wherein said first mechanism comprises a first lever, which is pivotally movable by said servomotor, said second mechanism comprises a second lever, which is pivotally movable by said travel control lever to describe a predetermined path, and said coupling means comprise a pawl, which is pivoted to said control rod and biased by said second spring means and carries first and second stops, said first lever is arranged to engage said first stop when said first mechanism has been moved from said inoperative position to and beyond said initial actuated position, said second stop is arranged to extend into said path when said coupling means are in said position of rest, and said first and second stops are arranged to be disposed outside said path when said coupling means are in said second position.

8. The control system set forth in claim 6, wherein said second mechanism comprises a linkage connecting said travel control lever to said second lever.

9. The control system set forth in claim 6, wherein said sensors comprise a sensor for detecting the position of said second lever and for delivering to said microcomputer an output signal representing the position of said travel control lever.

10. The control system set forth in claim 6, wherein a delivery-limiting stop is provided, which is disposed in said path and limits the pivotal movement of said second lever in a sense corresponding to the movement of said control rod in said predetermined direction.

11. The control system set forth in claim 10, wherein said delivery-limiting stop is adjustable.

12. The control system set forth in claim 7, wherein said first and second levers are pivoted one beside the other on a common pivot, said first and second stops consist of respective pins, which are laterally spaced from and parallel to said pivot, and said first stop is shorter than said second stop and always disposed outside said path.

13. The control system set forth in claim 7, wherein a position-defining stop is provided, which is arranged to be engaged by said first lever when said first mechanism is in said inoperative position, and said second spring means urge said first lever toward said position-defining stop.

14. The improvement set forth in claim 1, wherein said servomotor is adapted to perform said predetermined operation only when said sensors, said microcomputer and said servomotor are in operative condition and are operatively interconnected.

15. The control system of claim 3, wherein said electrical system is operable during said first predetermined operation and said electrical system is in failure during said second predetermined operation.

* * * * *